US005090515A

United States Patent [19]

Takahashi et al.

[11] Patent Number: 5,090,515

[45] Date of Patent: Feb. 25, 1992

[54] PASSENGER TRANSPORT INSTALLATION, VEHICLE FOR USE THEREIN, AND METHOD OF OPERATING SAID INSTALLATION

[75] Inventors: Tastuhiko Takahashi; Jun Sugahara; Toshihiko Nara; Yuki Yamamoto; Yoshinari Atsumi; Hideaki Seki; Katutaro Masuda; Nobuyoshi Sato; Masanobu Itoh; Masayuki Shigeta, all of Katsuta; Eiji Ikeda, Matsudo; Hiroshi Kinoshita, Hachioji; Shinkei Kakami, Mito, all of Japan

[73] Assignees: Hitachi, Ltd.; Hitachi Elevayor Engineering and Service Co., Ltd., both of Tokyo, Japan

[21] Appl. No.: 495,084

[22] Filed: Mar. 19, 1990

[30] Foreign Application Priority Data

Mar. 20, 1989 [JP] Japan ..... 1-066209

[51] Int. Cl.[5] ..... B66B 9/16

[52] U.S. Cl. ..... 187/16; 187/1 R

[58] Field of Search ..... 187/1 R, 16, 20, 80, 187/130, 135, 137, 138, 139

[56] References Cited

U.S. PATENT DOCUMENTS 3,750,849 8/1973 Berkovitz ..... 187/16
4,064,971 12/1977 Iwasaka et al. ..... 187/137
4,709,787 12/1987 Uchino ..... 187/1 R X
4,723,627 2/1988 Ito ..... 187/16
4,897,012 1/1990 Brewer ..... 187/16 X

FOREIGN PATENT DOCUMENTS 2154923 5/1973 Fed. Rep. of Germany .
53-119549 10/1978 Japan .
5431143 3/1979 Japan .
2203568A 10/1988 United Kingdom .

OTHER PUBLICATIONS

Stone, "Double Decker", Jan. 18, 1974, Article from Washington Star-News.

*Primary Examiner*—Robert P. Olszewski
*Assistant Examiner*—Dean A. Reichard
*Attorney, Agent, or Firm*—Antonelli, Terry, Stout & Kraus

[57] ABSTRACT

A passenger transport installation in which a large number of people can be efficiently transported between at least two vertically-spaced places. Stations communicate with a vertical elevator passage or passages along which vehicles can move upward and downward, and the vehicles stop at the stations to allow passagers to get on and off. While passengers get on and off the vehicles at the stations, other vehicles carrying other passengers can move upward and downwardly along the elevator passage or passages.

8 Claims, 16 Drawing Sheets

PASSENGER TRANSPORT INSTALLATION, VEHICLE FOR USE THEREIN, AND METHOD OF OPERATING SAID INSTALLATION

BACKGROUND OF THE INVENTION

This invention relates to a passenger transport installation or facilities suited for transporting a large number of people between at least two vertically-spaced places, a vehicle for use in such transport installation, and a method of operating such transport installation.

Japanese Patent Unexamined Publication Nos. 59-153773 and 61-188384 disclose typical examples of transport installations for mass-transporting people between at least vertically-spaced two places, in which an elevator device is used, with the interior of the cage or cab is vertically divided into upper and lower cage rooms. Japanese Patent Unexamined Publication No. 58-220068 discloses another type of transport installation in which a self-propelled cage carrying people is moved from one elevator passage to another and then is moved vertically.

In the above elevator device, the passengers get on and off the cage while the cage is stopped in the elevator passage, and therefore the flow of the passengers is not continuous. Particularly where the cage is for mass-transportation purposes and hence has a large passenger capacity, it takes more time for the passengers to get on and off the cage than for the cage to move up or down to a destination place. In this case, even if the speed of movement of the cage is increased, a period of time elapsed from a point of time when passengers get on the cage and to a point of time when they get off the cage at the destination place can not be substantially reduced, and the platform from which people get on and off the cage is always crowded.

Thus, although the above-mentioned conventional techniques are suited for transporting a large number of passengers at a time at high speed, a continuous transportation has not been taken into consideration. Therefore, the ability to transport passengers within a predetermined period of time, that is, the transport capability, has been limited.

SUMMARY OF THE INVENTION

It is therefore an object of this invention to provide a passenger transport installation in which a large number of people can be efficiently transported between at least two vertically-spaced places.

Another object of the invention is to provide a passenger transport installation and a method of operating such installation, in which even when passengers are getting on and off a vehicle, another vehicle can be moved upward or downward.

A further object of the invention is to provide a passenger transport installation of which transport capability can be improved without increasing the number of elevator passages along which vehicles move upward or downward.

In one aspect of the present invention, stations to which vehicles are conducted from an elevator passage and where the vehicles stop to enable passengers to get on and off the vehicles are provided to communicate with the elevator passage.

The vehicles can be moved upward and downward along the elevator passage by holder means, and can be disengaged from the holder means so as to move toward the stations.

The vehicles can be moved upward and downward along the elevator passage while passengers get on and off other vehicles at the stations.

Since the passengers can get on and off the vehicles stopped at the stations spaced from the elevator passage, the elevator passage is not blocked when the passengers get on and off the vehicles. Therefore, while the passengers get on and off the vehicles at the stations, other vehicles can be moved along the elevator passage. Thus, the elevator passage can be exclusively used for upward and downward movement of vehicles, thereby enhancing a transport capability.

DESCRIPTION OF THE PREFERRED EMBODIMENTS OF THE INVENTION

Figure 1:
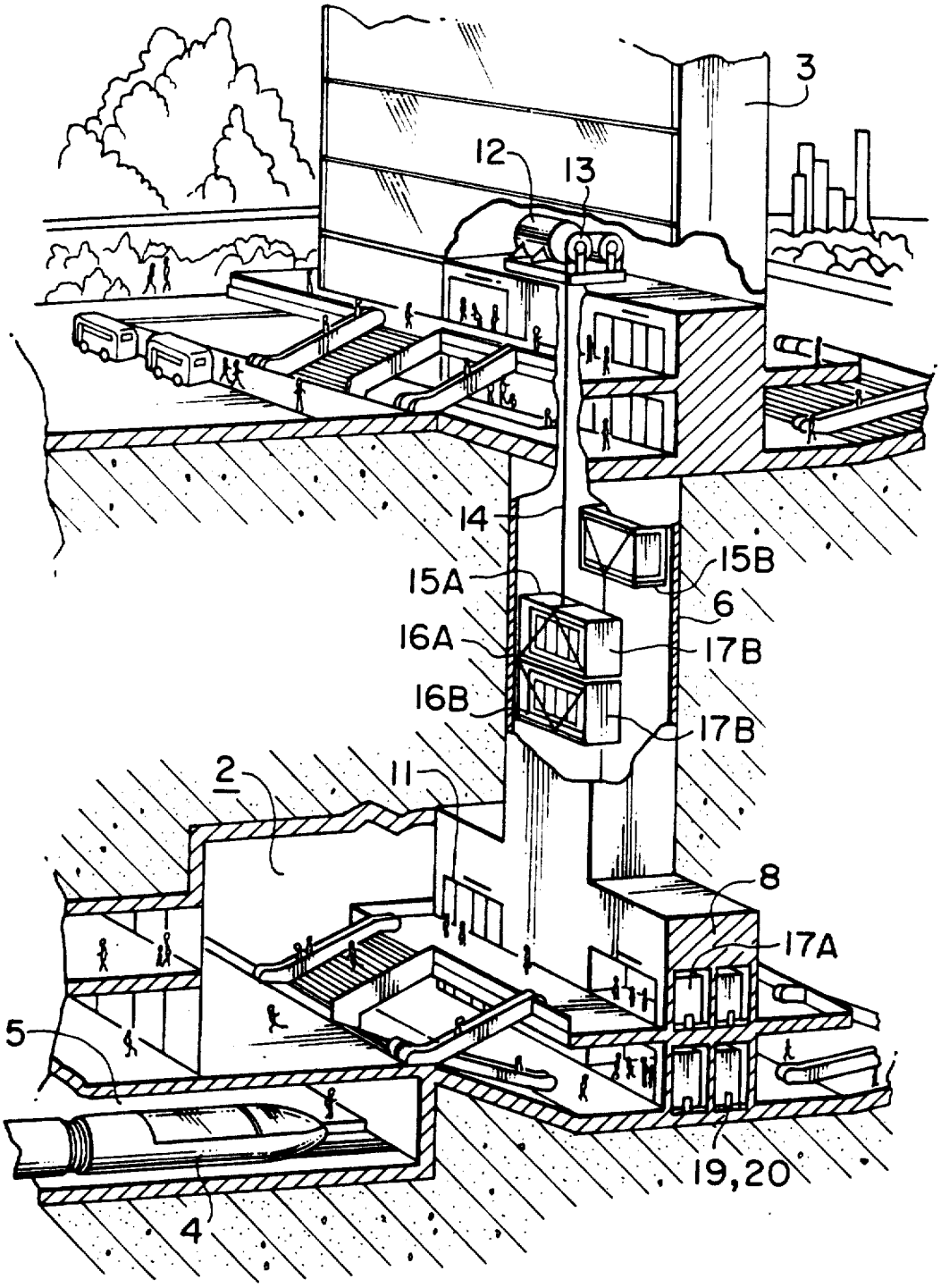
FIG. 1 is a partly-broken, perspective view of a passenger transport installation according to the present invention.
Figure 2:
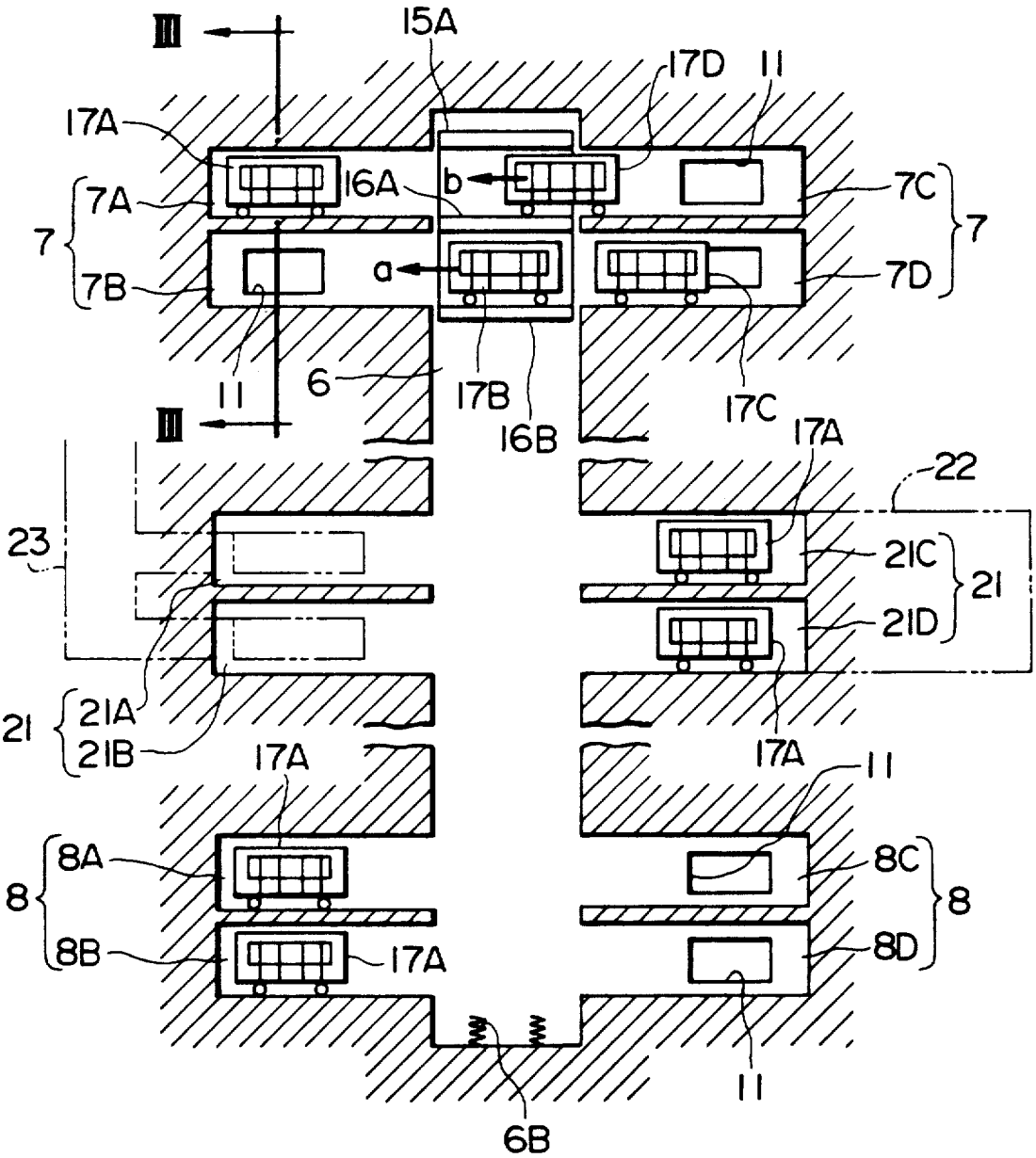
FIG. 2 is a vertical cross-sectional view of the transport installation of FIG. 1 in the vicinity of an elevator passage.
Figure 3:
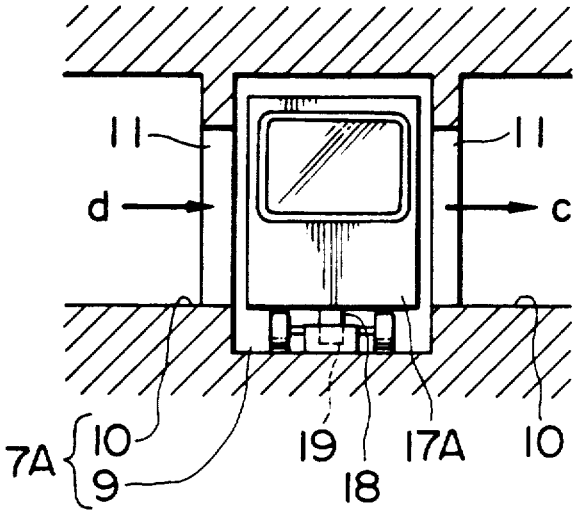
FIG. 3 is an enlarged cross-sectional view taken along the line III—III of FIG. 2.
Figure 4:
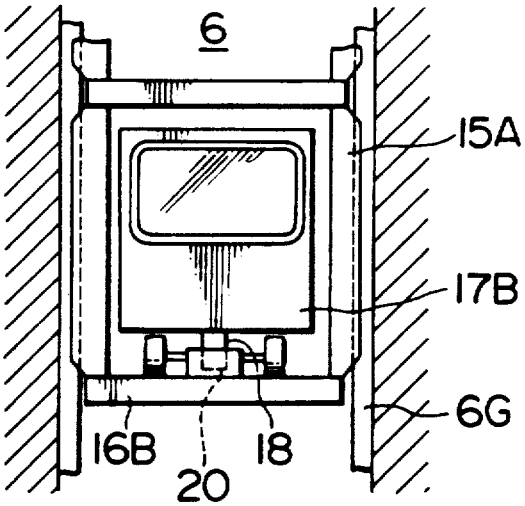
FIG. 4 is a front-elevational view showing a holder and a vehicle, used in the installation of FIG. 1.

As shown in FIGS. 1–4, a passenger transport installation for transporting passengers between the ground 1 and an underground space 2 which are spaced vertically from each other includes an elevator passage 6 vertically extending between one or all of floors of a building 3 on the ground 1 and an underground space 2 which, for example, may be a subway platform 5 where people get on and off a subway train 4. Two-stage (upper and lower) top stations 7 (7A to 7D) where people get on and off vehicles are provided at and communicated with the upper end portion of the elevator passage 6. Similarly, two-stage (upper and lower) bottom stations 8 (8A to 8D) are provided at and horizontally communicated with the lower end portion of the elevator passage 6. Each of the top and bottom stations 7 and 8 includes a travel passage 9 along which vehicles 17A to 17D can move, and platforms 10 disposed at substantially the same level as the floor of the vehicles 17A to 17D when the vehicles 17A to 17D are disposed at that station (FIG. 3). The travel passage 9 communicates with the platform 10 through an inlet/outlet opening 11 which may either be kept open or be closable by an associated shutter such as a door. Provided above the upper end of the elevator passage 6 is a machine room accommodating a motor 12 as well as juxtaposed rope wheels 13 driven for rotation either directly by the motor 13 or indirectly thereby through a speed reducer. A rope 14 is extended around the rope wheels 13 in such a manner that the opposite ends of the rope 14 are suspended in the elevator passage 6. Elevator frames (holders) 15 (15A and 15B) are connected to the opposite ends of the rope 14, respectively. Each of the elevator frames 15A and 15B includes two-stage (upper and lower) floors 16A and 16B, and the distance between the upper and lower floors 16A and 16B is equal to the distance between the bottoms of the two-staged top stations 7A and 7B and to the distance between the bottoms of the two-staged bottom stations 8A and 8B. Guide rails 6G are mounted in and extend along the elevator passage 6, and each of the elevator frames 15A and 15B is guided by the guide rails 6G for movement therealong. Although not shown in the drawings, each of the floors 16A and 16B of the elevator frame is provided with a guide means by which the vehicles 17A to 17D are guided onto the floors in a horizontal direction. The guide means may be a passage identical in configuration to the travel passage 9 of the station 7, 8. Specifically, the guide means may be provided with guide fences, guide rails or the like. The vehicles 17A to 17D are movable by wheels, and each vehicle also includes a stopper 18 extending downwardly from its floor. The stopper 18 is engageable with positioning stoppers 19 provided at predetermined positions in the travel passage 9 for the stations 7A to 7D, and is also engageable with connecting stoppers 20 provided at the floors 16A and 16B of the elevator frames 15A and 15B.

In the above construction, for example, when going from the ground 1 to the underground space 2, passengers go to either the upper or lower platform 10 of the top stations 7A to 7D, and pass through the opening 11 to get on the vacant vehicles 17A. Immediately when the number limit is reached or when it comes time to start, the door is closed even if the number limit has not yet been reached. Simultaneously with the getting-on and off at the top station 7, passengers get on and off the vehicles 17A at the bottom station 8. At this time, that is, during the time when the passengers get on and off the vehicles at the stations 7 and 8, the elevator frames 15A and 15B, holding the respective vehicles 17B carrying passengers, are moving upward and downward, or the vehicles 17B are moving from the elevator frame 15A, stopped at the floor, toward the top station 7B as indicated by arrow a in FIG. 2 (Similarly, at this time, the vehicles 17B are moving from the elevator frame 15B toward the bottom station 8B).

After the vehicles 17B reach the stations 7 and 8 from the respective elevator frames 15A and 15B stopped at the respective floors, the stopper 18 of each of the stand-by vehicles 17A holding the passengers is disengaged from the positioning stopper 19 at the travel passage 9, so that the vehicles 17A become the moving vehicles 17D to be moved into the elevator frame 15A, 15B, as indicated by arrow b for the elevator frame 15A. Then, the stopper 18 of each vehicle 17D is engaged with the connecting stopper 20 mounted on the floor 16B of the elevator frame 15A, 15B. Here, the vehicles 17D are ready to move upward and downward, respectively, and are now indicated by reference numeral 17B. When the vehicles 17B are completely loaded respectively into the elevator frames 15A and 15B disposed respectively at the upper and lower ends of the elevator passage 6, the motor 12 is driven to move the two elevator frames 15A and 15B upward and downward.

The movements of the elevator frames 15A and 15B as well as the movements of the vehicles 17A to 17D are repeated in the above-mentioned manner, thereby transporting the passengers.

Passengers can smoothly get on and off each vehicle 17A by the provision of the platforms 10 on the opposite sides of the travel passage 9, as shown in FIG. 3. In this case, those passengers getting off are led out of the vehicle 17A in a direction of arrow c, and after those passengers get off, the waiting passengers are led into the vehicle 17A in a direction of arrow d, thereby avoiding crowding at the station.

In embodiment of FIGS. 1-4, the places where the passengers get on and off the vehicles 17A are spaced away from the elevator passage 6, the elevator frames 15A and 15B carrying other vehicles can be moved upward and downward in the elevator passage 6 even when passengers get on and off the vehicles 17A. Therefore, the vehicles can always be moved along the elevator passage 6, thereby increasing the transport capability.

In the above embodiment, although the two-stage elevator frames 15A and 15B are connected respectively to the opposite ends of the rope 14 and are suspended-in the single elevator passage 6, there may be provided two juxtaposed elevator passages 6 such that the elevator frames 15A and 15B are caused to move upward and downward in the two elevator passages, respectively, independently of each other. The elevator frame 15A and 15B are not limited to a two-stage construction, and may be of a one-stage construction or a more than two-stage construction.

In FIG. 2, reference numeral 6B denotes a shock absorber mounted at the bottom of the elevator passage 6.

In the above embodiment, the vehicles 17B are loaded respectively into the upper and lower stages of the elevator frames 15A and 15B. However, there are some time zones or periods when there is not a large number of passengers. At these time zones, the transportation can be carried out by loading only one vehicle 17B into one of the two stages of each of the elevator frames 15A and 15B. In this case, as shown in FIG. 2, the vehicle 17B is moved from the lower stage of the elevator frame 15A into the lower top station 7B, and at the same time the vehicle 17D is loaded from the upper top station 7C into the upper stage of the elevator frame 15A, thereby further shortening the operation time.

Although the embodiment of FIGS. 1-4 is directed to the transport installation for transporting passengers between the ground 1 and the underground space 2, the invention can, of course, be used for transporting the passengers between the ground 1 and the uppermost floor of the building 3.

In the embodiment of FIGS. 1-4, the vertical elevating distance is long, and there is no elevator-stop floor intermediate the ground 1 and the underground space 2. In this case, if an accident or an emergency occurs during the upward and downward movements of the elevator frames 15A and 15B along the elevator passage 6, it may be impossible to move the elevator frames 15A and 15B to the top and bottom stations 7 and 8. In such a case, shelter yards 21 (21A to 21D) can be provided intermediate the opposite ends of the elevator passage 6 with the number of the shelter yards 21 corresponding to the number of the stages of the elevator frames 15A and 15B, respectively. Where each shelter yard 21 has an increased depth, it can be used for storing a spare vehicle 17A or for temporarily storing the vehicle. Further, work spaces 22 can be provided back from to communicate with the shelter yards 21C and 21D used for vehicle storage purposes, as shown in FIG. 2, in which case simple checking or repair of the vehicles 17A can be made without stopping the operation of the vehicles 17B. Further, shelter passages 23, for example, communicating with the shelter yards 21A and 21B can be provided, in which instance in the case of an emergency, passengers on the vehicles 17A taking shelter in the shelter yard 21A and 21B can be guided into a safe place via the shelter passages 23.

Figure 5:
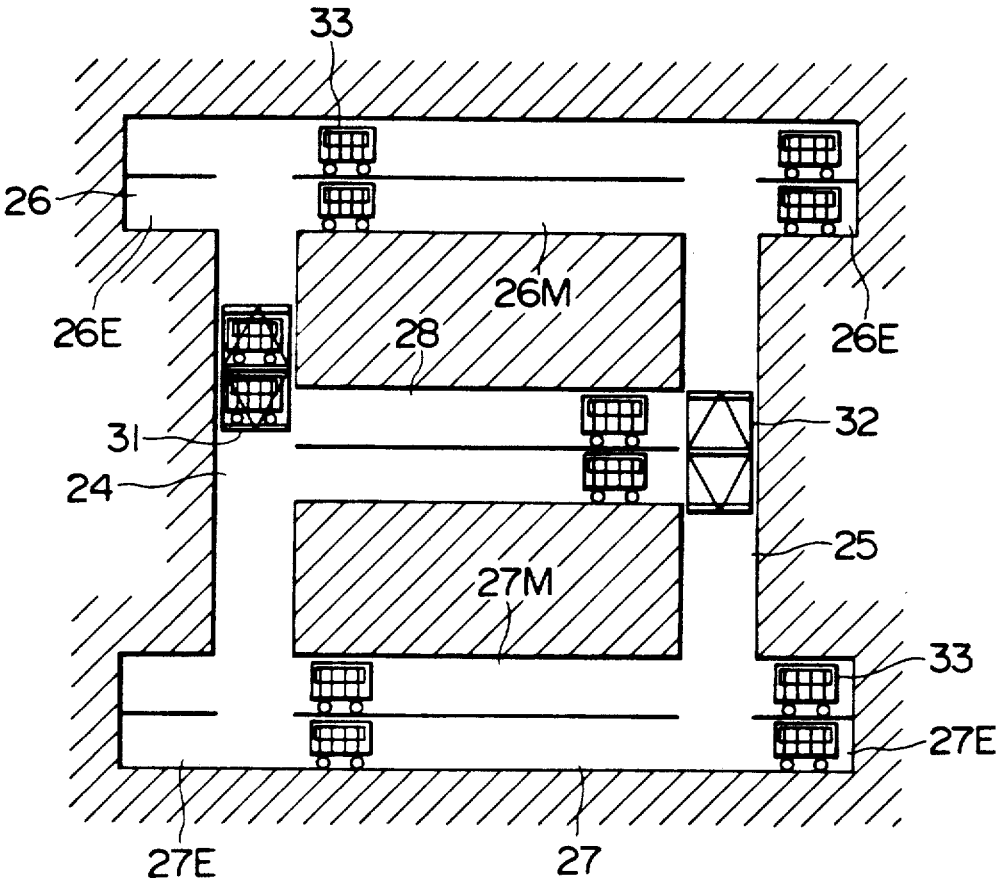
FIG. 5 is a vertical cross-sectional view of a modified elevator passage used in the transport installation of the invention.
Figure 6:
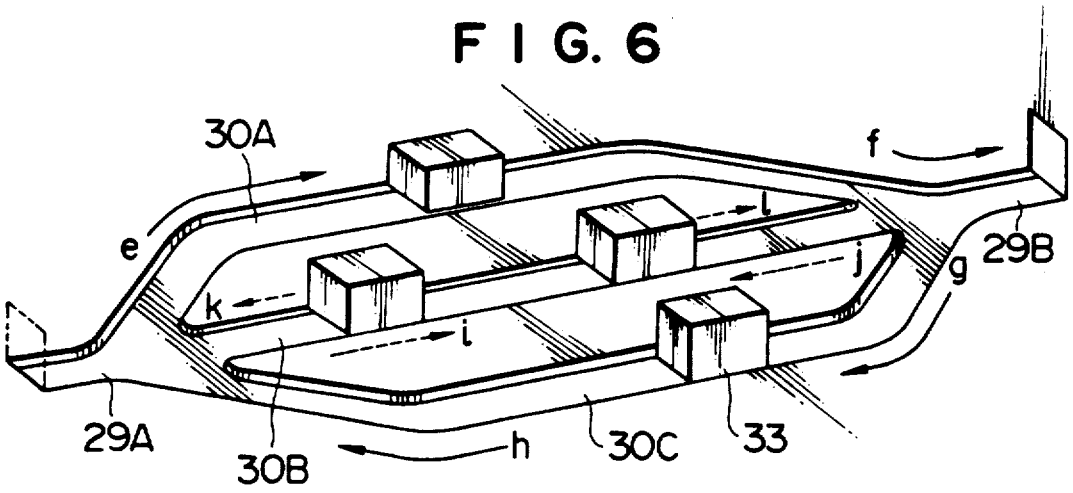
FIG. 6 is a perspective view of a station of the installation of FIG. 5.

A modified passenger transport installation as shown in FIGS. 5 and 6, wherein a pair of vertical elevator passages 24 and 25 are provided in spaced relationship to each other. The upper ends of the two elevator passages 24 and 25 are communicated with each other by a top station 26, and the lower ends thereof are communicated with each other by a bottom station 27. The midway portions of the elevator passages 24 and 25 are communicated with each other via a communication passage 28. The top station 26 has end stations 26E and an intermediate station 26M, and similarly the bottom station 27 has end stations 27E and an intermediate station 27M. Each of the intermediate stations 26M and 27M has inlet/outlet passages 29A and 29B at the opposite ends thereof, and a plurality of passages 30A to 30C extending between the inlet/outlet passages 29A and 29B. Optionally, the communication passage 28 may be of the same construction as that of the intermediate stations 26M and 27M. Each of the stations 26 and 27 has a travel passage 9 along which the vehicles move, and platforms 10, as shown in FIG. 3. If it is necessary for passengers to get on and off the vehicle at the communication passage 28, the communication passage 28 may have platforms 10 as shown in FIG. 3. In the above construction, elevator frames 31 and 32 move upward and downward along the elevator passages 24 and 25, respectively. The transport installation can be so designed that the two elevator frames 31 and 32 can move along the two elevator passages 24 and 25, respectively, as shown in the embodiment of FIGS. 5 and 6. Alternatively, the transport installation may be so designed that two such elevator frames can move along each of the two elevator passages, as described above in the preceding embodiment of FIGS. 1-4. The operation of the vehicles 33 with respect to the elevator frames 31 and 32 is carried out in a manner similar to that described above with reference to FIG. 2. More specifically, while passengers get on and off the vehicles 33 at the top and bottom stations 26 and 27, other vehicles 33 carrying passengers move along the elevator passages 31 and 32, thereby achieving an efficient transportation of the passengers.

As described above in connection with FIG. 6, the intermediate stations 26M and 27M (and optionally the communication passage 28), interconnecting the two elevator passages 24 and 25, have the plurality of passages 30A and 30C. With this arrangement, for example, the vehicle 33, moving upward along the elevator passage 24, can be moved into the intermediate station 26M to be guided into the passage 30A as indicated by arrow e, allowing passengers to get on and off this vehicle 33. At this time, if there is no other vehicle 33 in the passage 30A and if the elevator frame 32 is on stand-by at the opposite elevator passage 25, the above vehicle 33 guided into the passage 30A can be loaded into the elevator frame 32 via the inlet/outlet passage 29B, as indicated by arrow f, so that this vehicle can be moved downward. Also, when the vehicles 33 move upward along the respective elevator passages 24 and 25 at the same time, and are guided into the intermediate station 26M, one of the vehicle 33 can be guided into the passage 30A as indicated by arrows e and f, whereas the other vehicle 33 can be guided into the passage 30C as indicated by arrows g and h. Thus, many vehicles 33 can be operated smoothly. Further, when the passages 30A and 30C are occupied by the vehicles and when other vehicles 33 enter the inlet/outlet passages 29A and 29B, respectively, these vehicles 33 can be guided, for example, into the vacant passage 30B, in the directions as indicated by arrows i and j, allowing passengers to get on and off these vehicles 33. Then, the vehicles 33 are moved in the directions as indicated by arrows k and l to return respectively to the inlet/outlet passages 29A and 29B, thereby achieving a smooth operation of the vehicles 33.

Figure 7:
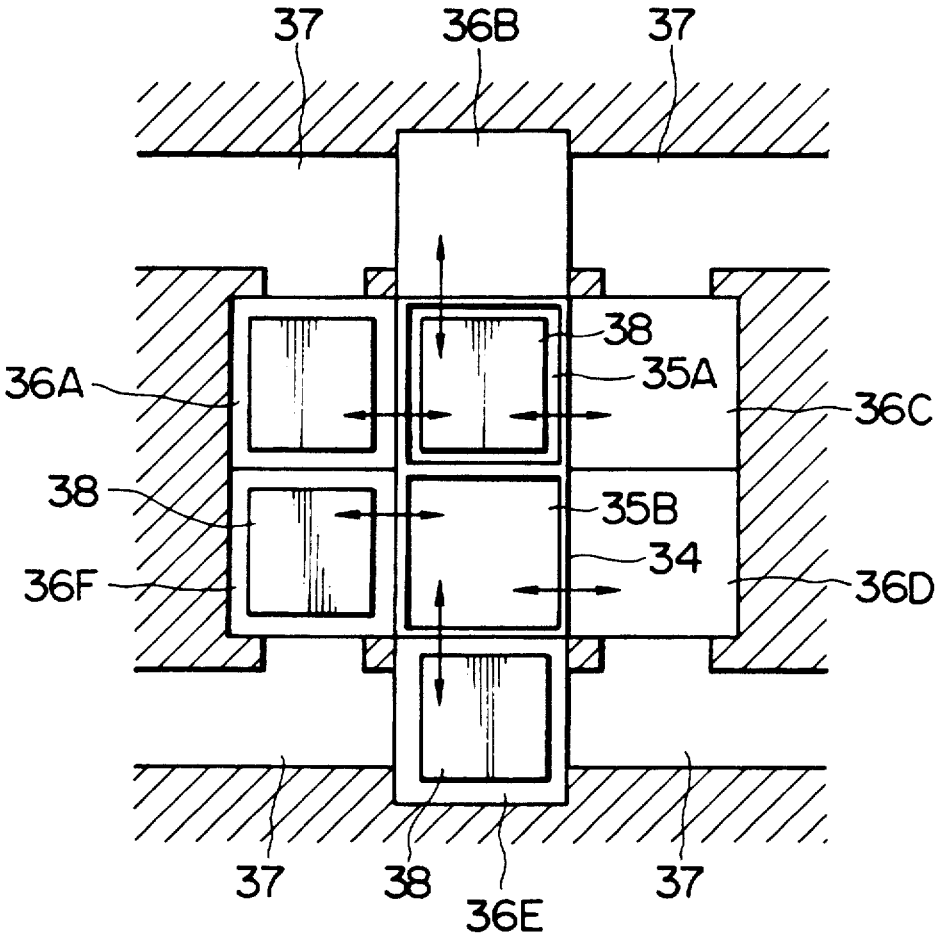
FIGS. 7 and 8 are horizontal cross-sectional views of modified forms of the invention, respectively, showing the relation between an elevator passage and a station.
Figure 8:
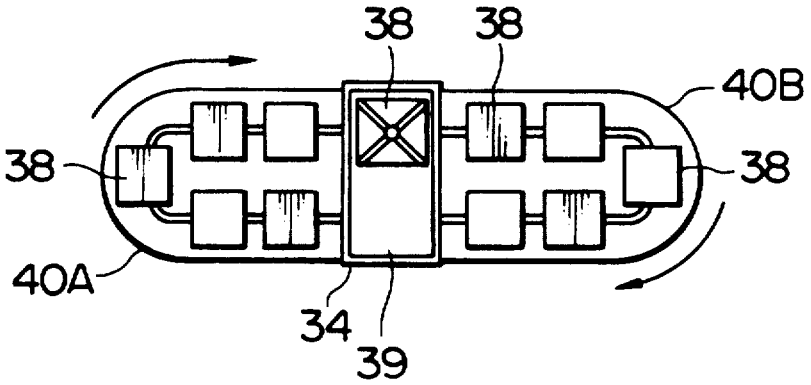

FIG. 7 shows a construction in which two elevator frames 35A and 35B are adapted to move upward and downward along an elevator passage 34. Three vehicle stand-by places 36A to 36C are provided respectively in facing relation to three sides of the elevator frame 35A in a stopped position, and similarly three vehicle stand-by places 36D to 36F are provided respectively in facing relation to three sides of the elevator frame 35B in a stopped position. Platforms 37 are provided adjacent to the stand-by places 36A to 36F, respectively. With this arrangement, the unloading of the vehicles 38 from the elevator frames 35A and 35B is carried out at the same time when the loading of other vehicles 38 into the elevator frames 35A and 35B is carried out. Also, passengers get on the vehicle at the same time when other passengers get off other vehicle. The movements of the vehicles 38 on a horizontal plane are carried out as indicated by arrows in FIG. 7, and therefore the schedule of the operation can be determined in a less limited manner. This construction may be so modified that only one elevator frame can be moved along the elevator passage 34, in which case four stand-by places may be provided on all of the four sides of the elevator frame in a stopped position. Referring to FIG. 8, a single elevator frame 39 is adapted to move along a single elevator passage 34, and vehicle travel passages 40A and 40B are provided on the opposite sides of the elevator passage 34, respectively. The elevator frame 39 has a horizontal size capable of holding two vehicles 38, and each of the travel passages 40A and 40B has a U-shaped track along which the vehicle 38 is movable When the elevator frame 39 is stopped at a position opposed to the travel passages 40A and 40B, all the vehicles 38 are moved in a direction as indicated by arrows, so that the vehicles 38 within the elevator frame 39 are moved into the travel passages 40A and 40B, respectively. At the same time, other vehicles 38 having been in the travel passages 40A and 40B are moved into the elevator frame 39. During the upward or downward movement of the elevator frame 39, passengers can get on and off the vehicles 38 disposed at the travel passages 40A and 40B.

Figure 9:
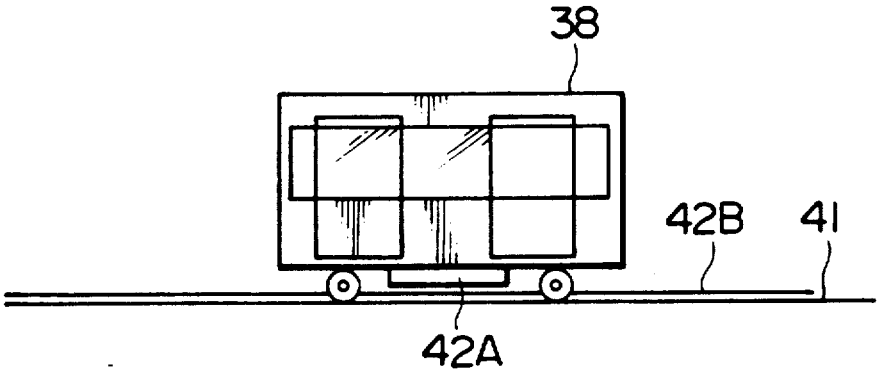
FIGS. 9 to 11 are side-elevational views of vehicles incorporating respective drive devices of different kinds used in the present inventions.
Figure 10:
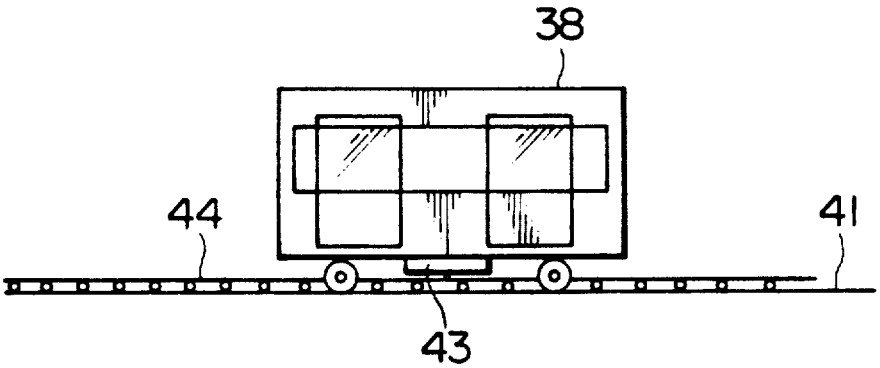
Figure 11:
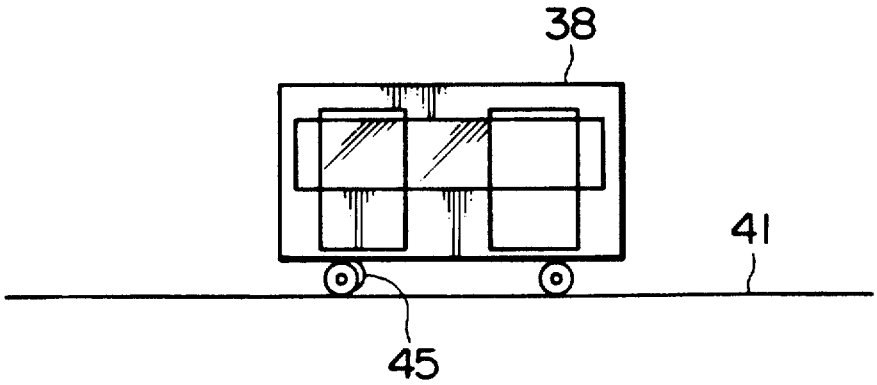

FIGS. 9 to 11 respectively show drive devices for driving a vehicle 38 for horizontal movement. More specifically, in FIG. 9, the vehicle 38 is driven by a linear motor. A reaction plate 42B is laid on each of a travel floor 41 (on which the vehicle 38 moves) and the floor of the elevator frame. A magnetic pole 42A is provided on the lower surface of the floor of the vehicle 38 disposed in opposed relation to the reaction plate 42B. In FIG. 10, for example, a chain 44 moving in the direction of movement of the vehicle 38 is provided on the travel floor 41 on which the vehicle 38 moves. A chain engaging device 43 is mounted on the vehicle 38. The vehicle 38 is moved and stopped by causing the chain engaging device 43 to engage and disengage the chain 44. In FIG. 11, a drive motor 45 is mounted on a vehicle 38, and the drive motor 45 drives the wheels of the vehicle to thereby move the vehicle. These drive devices are shown merely by way of example, and any other suitable known drive device or moving device can be used.

Figure 12:
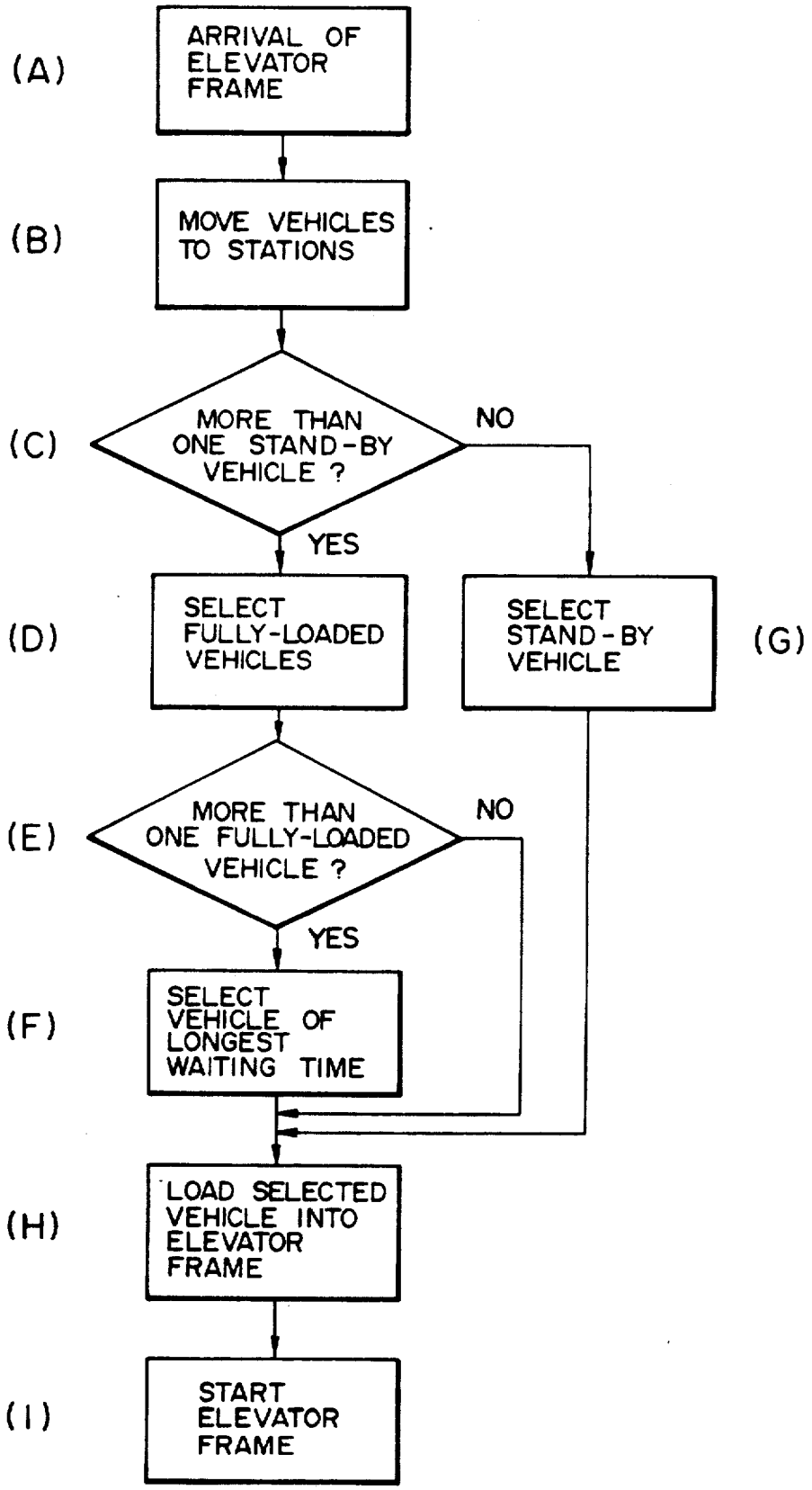
FIG. 12 is a flow chart for operating the passenger transport installation.
Figure 13:
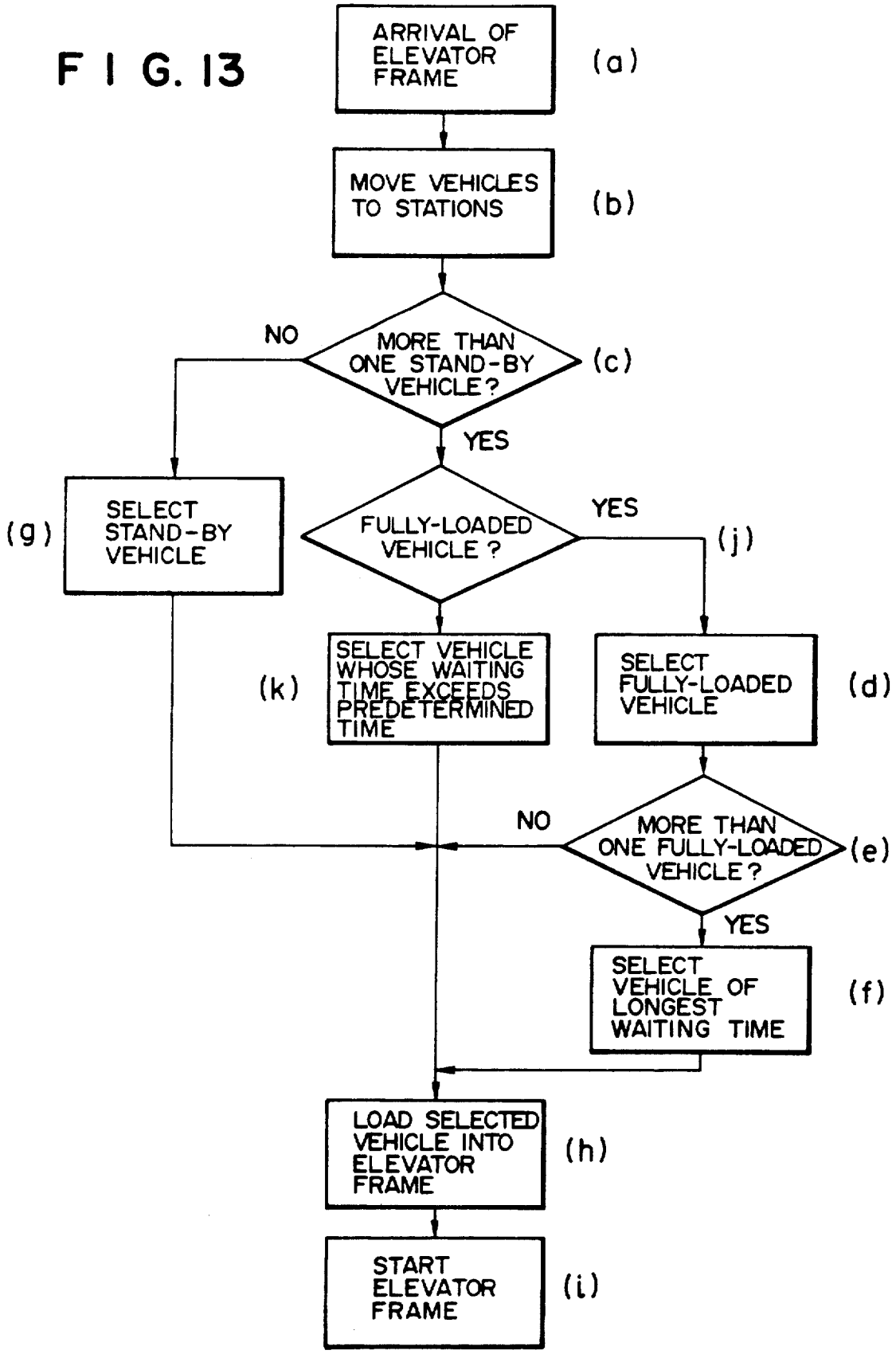
FIG. 13 is a flow chart similar to FIG. 12 but showing a modified operation.

FIGS. 12 and 13 each shows a flow chart for determining the priority order of start of the vehicles. Referring to FIG. 12, the elevator frame arrives (Step A). The vehicles are moved to the stations, (Step B), and it is judged whether or not there is more than one stand-by vehicle (Step C). If there is not more than one stand-by vehicle, the vehicle is loaded into the elevator frame, and the elevator frame is started (Steps G, H and I). On the other hand, if there is more than one stand-by vehicle, the vehicle or vehicles fully loaded with passengers are selected from these stand-by vehicles (Step D). If there is more than one fully-loaded vehicle, the vehicle whose waiting time is the longest is selected (Steps E and F). The thus selected vehicle is loaded into the elevator frame, and the elevator frame is started (Steps H and I). Thus, the fully-loaded vehicles are selected according to the priority based on the waiting time, and therefore the transport efficiency can be enhanced at those times when a large number of the passengers are to be transported.

Referring to FIG. 13, Steps (a) to (c) are the same as Steps A to C of FIG. 12, respectively. If there is more than one stand-by vehicle, it is judged whether or not the stand-by vehicles are fully loaded with passengers (Step (j)). If there is no fully-loaded vehicle, the vehicle whose waiting time exceeds a predetermined period of time is selected (Step (k)). If there is at least one fully-loaded vehicle, such vehicle is selected (Step (d)). If there is more than one fully-loaded vehicle, the vehicle whose waiting time is the longest is selected (Steps (e) and (f)). The selected vehicle is loaded into the elevator frame, and the elevator frame is started (Steps (h) and (i)). If there is not more than one stand-by vehicle, this vehicle is selected and is loaded into the elevator frame, and the elevator frame is started (Steps (c), (g), (h) and (i)). Thus, the transport efficiency can be enhanced at those times when there is not a large number of passengers to be transported.

The above embodiments are intended merely to improve the capability of transporting passengers between at least two vertically-spaced places. However, the operation of the passenger transport installation may be needed to be related to the operation of other transportation facilities, such as a subway schedule as shown in FIG. 1. Therefore, the operation of a passenger transport installation will now be described with reference to FIGS. 14 and 15, in which it takes less time for passengers to wait for a subway train running according to the schedule, and the transport can be carried out efficiently.

Figure 14:
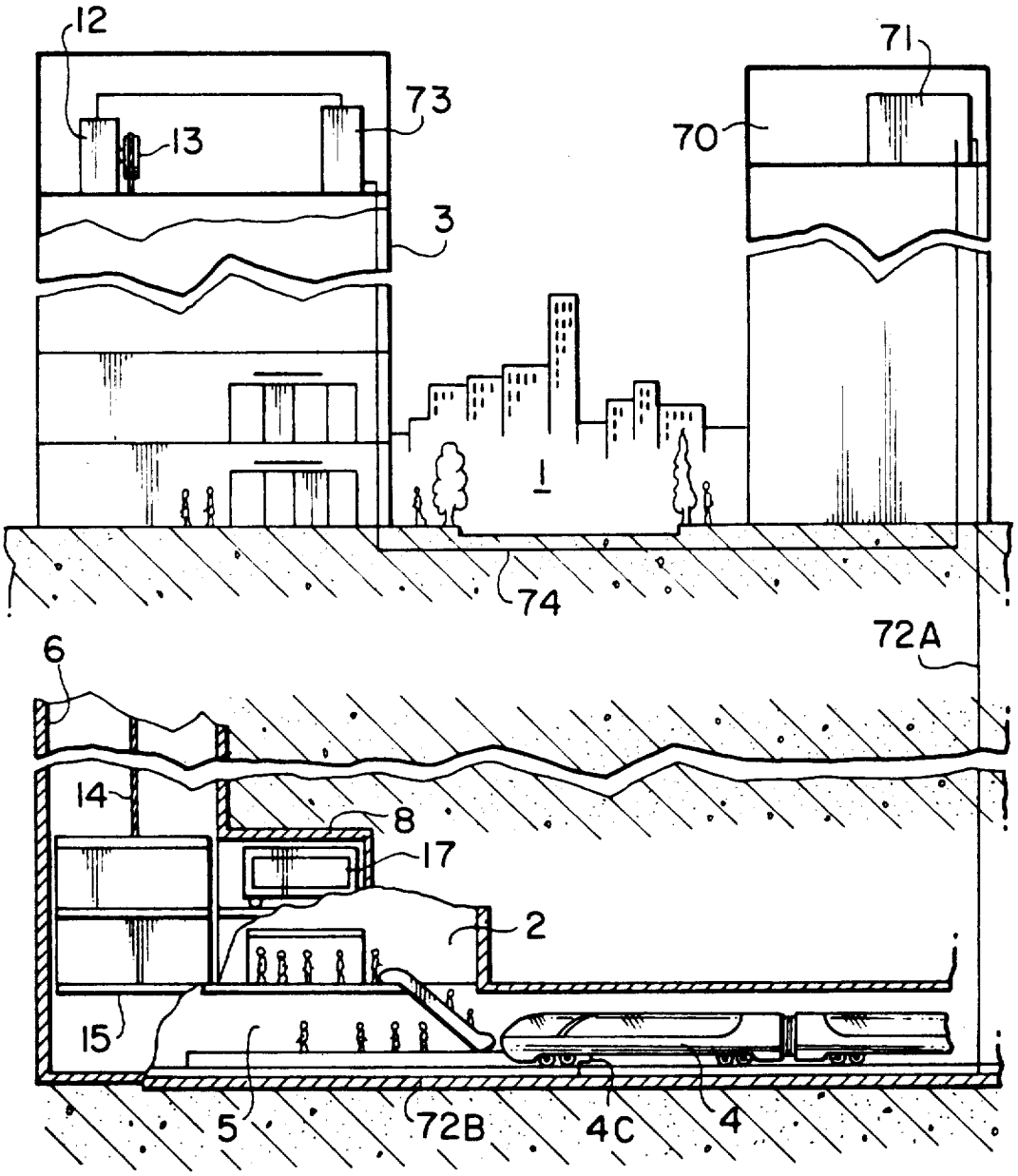
FIG. 14 is a partly-broken view of a further modified passenger transport installation of the present invention.

The passenger transport installation of FIG. 14 is similar to the passenger transport installation of FIG. 1 in that a building 3 on the ground 1 and an underground space 2 are interconnected by an elevator passage 6, that an elevator frame (holder) 15 is mounted within the elevator passage 6 for vertical movement therealong, that a rope is connected to the elevator frame 15 and is extended around a rope wheel 13 which is driven by a motor 12, that vehicles 17 are adapted to be loaded into the elevator frame 15, with the station 8 being provided at which the vehicles 17 are unloaded from the elevator frame 15 to allow passengers to get on and off the vehicle. The station 8 communicates with the elevator passage 6, and the underground space 2 communicates with a subway platform 5 for a subway train 4. The subway train 4 is run or operated on schedule according to instructions given by an operation control device 71 provided within an operation instruction room 70. The operation instructions are fed from the operation control device 71 to the train 4 via signal lines 72A and 72B and a signal receiver device 4C. The operation control device 71 is connected via a data communication line 74 to a controller 73 for controlling the operation (upward and downward movement) of the elevator frame 15, so that train operation information, such as train arrival information and train destination information, is transmitted to the controller 73. The controller 73 operates the elevator frame 15 in accordance with the train operation information, so that the elevator frame 15 is moved in connection with the operation of the train 4.

Figure 15:
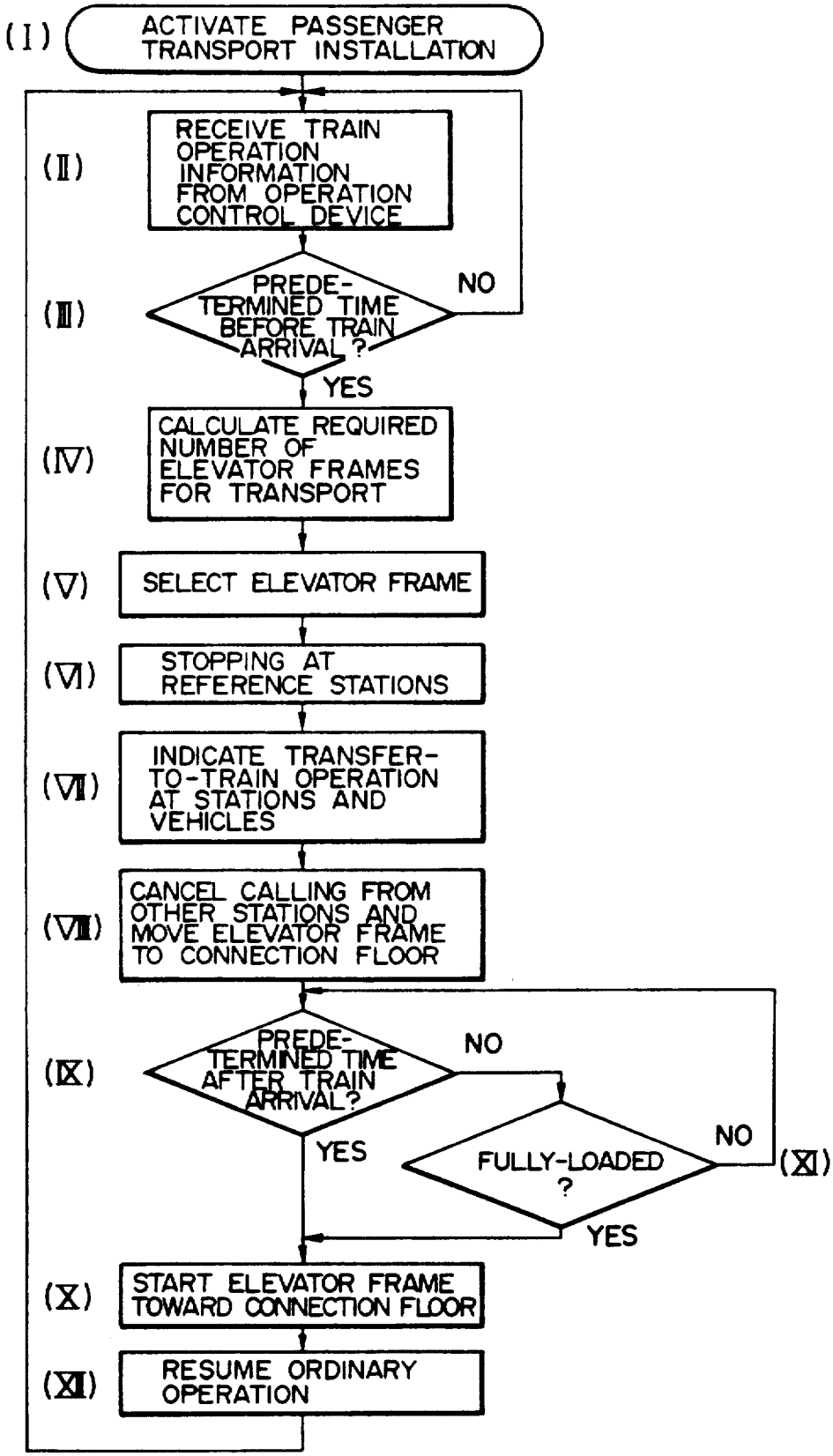
FIG. 15 is a flow chart for operating the installation of FIG. 14.

The operation of the elevator frame 15 as well as the operation of the train 4 will now be described with reference to a flow chart of FIG. 15. First, the passenger transport installation is activated, that is, put into an operative condition (Step I), and ordinary services are started. In this condition, the controller 73 receives the subway train operation information from the operation control device 71 within the operation instruction room 70 (Step II). It is judged whether or not the time when this train operation information is received by the controller 73 is a predetermined period of time before the train arrives (Step III). If this time is not the predetermined time before the train arrival, the ordinary services are continued. If this time is the predetermined time before the train arrival, a required number of the elevator frames for transporting passengers (who are to transfer to the train) is calculated (Step IV). The calculated number of the elevator frames are selected (Step V), and the elevator frames are once stopped at the reference stations (Step VI). Then, an indication of a transfer-to-train operation is made within the vehicles within the thus stopped elevator frames and is also given to the reference stations (Step VII), thus giving information service telling the departure time of the transfer train, its destination, the line of the subway platform where the train arrives, and so on. Further, the calling from other stations to the elevator frame stopped at the reference station is not accepted, and if such calling is already accepted, such acceptance is canceled and is assigned to other elevator frame or frames. And, before the arrival of the train, the elevator frame is caused to reach the station communicating with the subway platform, allowing the passengers to get off the vehicle (Step VIII), so that the vehicle is on stand-by for receiving passengers who will get off the train. Then, it is judged whether or not a predetermined period of time is passed after the train arrives (Step IX). If the predetermined period of time is passed, the elevator frame is started to move toward the connection floor (Step X). Even if the predetermined period of time is not passed, it is judged whether or not the vehicle is fully loaded with passengers (Step XI). If this judgment is YES, the elevator frame is started to move toward the connection floor (Step X). If the judgment is NO, the elevator frame remains stand-by until the predetermined period of time is passed (Step IX). After the passengers get off the vehicle upon arrival of the elevator frame at the connection floor, the operation of the passenger transport installation is separated from the operation of the subway train, and the ordinary services are resumed (Step XII).

In this embodiment, passengers never fail to meet the train, and the time required for the passengers (who get off the train) to wait for the vehicles can be shortened.

In this embodiment, in case the number of the elevator passages as well as the number of the elevator frames is small, the operations of all the elevator frames may be related to the train operation. In case the number of the elevator passages as well as the number of the elevator frames is large, the number of the elevator passages to be used as well as the number of the elevator frames to be operated may be determined in accordance with the schedule of the subway. Also, the number of the elevator passages may be increased to provide a separate passenger transport installation which is exclusively operated in accordance with the schedule of the subway.

In the above embodiments, the elevator frames moving along the elevator passages are suspended by the rope, and this rope is extended around the rope wheels and is driven. However, the elevator frame may be moved upward and downward by winding and unwinding the rope relative to a drum. In any case, the elevator frame is reciprocally moved upward and downward. If it is desired to further increase the transport capability, this can be done by increasing the size of the vehicle and by increasing the speed of upward and downward movement of the elevator frame. However, such procedures are expensive at present, and therefore are not practical. For this reason, it is desirable to provide a transport installation of FIGS. 16 to 19 which can continuously move vehicles.

Such transport installation will now be described with reference to FIGS. 16 to 19 wherein two elevator passages 46 and 47 are provided and are spaced from each other and extend between a building 3 on the ground and an underground space 2. The upper ends of the two elevator passages 46 and 47 are interconnected by an upper horizontal passage 48, and the lower ends thereof are interconnected by a lower horizontal passage 49, thereby forming a square-shaped continuous passage as a whole. A pair of sprockets 50 are provided at each of the four corners of this square-shaped passage. A pair of endless chains 51 are extended respectively around the sprockets 50 at each of the four corners. At least one pair of sprockets 50 at one of the four corners are connected to a motor (not shown) so as to be driven. A plurality of support members 52 are rotatably connected between the pair of chains 51 extending around the sprockets 50. The support members 52 are support or holder members corresponding to the elevator frames 15, 31, 32, 35A, 35B and 39 of the above-mentioned embodiments. For example, the support member 52 is in the form of a rod or shaft. A grip mechanism 54 for releaseably gripping the support member 52 is mounted on each of vehicles 53. By releaseably engaging the grip mechanism 54 with the support member 52, the vehicle 53 can be moved upward and downward along the elevator passages 46 and 47 and also can be moved horizontally along the upper and lower horizontal passages 48 and 49.

Upper inlet/outlet openings 55A and 55B are provided adjacent the upper horizontal passage 48, and lower inlet/outlet openings 56A and 56B are provided adjacent the lower horizontal passage 49. A top station 7 communicates with the upper horizontal passage 48 via the upper inlet/outlet openings 55A and 55B, and a bottom station 8 communicates with the lower horizontal passage 49 via the lower inlet/outlet openings 56A and 56B. As described above in the embodiment of FIG. 3, each of the top and bottom stations 7 and 8 comprises travel passages 9 along which the vehicles 53 moves, and platforms 10 where passengers get on and off the vehicles.

A portion L1 (FIG. 18) of the horizontal passage 48 (49) extending between the elevator passage 46 and the inlet/outlet opening 55A (56A), as well as portion L2 (FIG. 18) of the horizontal passage 48 (49) extending between the elevator passage 47 and the inlet/outlet opening 55B (56B), is a synchronizing area where the speed of the chains 51 is equal to the speed of movement of the vehicles 53.

The vehicle 53 has a suspension frame 57 connectable to the grip mechanism 54, and has entrance/exit openings 58A and 58B opening transverse to the direction of travel of the vehicle. The vehicle 53 also has wheels 59 by which the vehicle is moved on the travel passages 9. The wheels 59 are driven by a motor 60 for self-propelling purposes.

Next, the operation of the transport installation of this construction will now be described. First, reference is made to the case where the chains 51 are driven in such a manner that the elevator passage 46 is used only for downwardly moving the vehicles whereas the other elevator passage 47 is used only for upwardly moving the vehicles. In this case, for example, when going from the top station 7 to the bottom station 8, passengers get on one of the vehicles 53 at the upper platform 10. When the number limit with respect to this vehicle 53 is reached or upon lapse of a predetermined period of time period, the vehicle 53 is moved along the travel passage 9 toward the upper inlet/outlet opening 55A, and is introduced into the upper horizontal passage 48 through the opening 55A. Then, this vehicle 53 within the upper horizontal passage 48 moves toward the lowering elevator passage 46 at a speed substantially equal to the speed of the chains 51, and at the same time the grip mechanism 54 grips the support member 52 on the chains 51. As a result of this gripping, the vehicle 53 is guided toward the elevator passage 46 and is lowered therealong. Then, the vehicle 3 is guided into the lower horizontal passage 49 at the lower end of the elevator passage 46, and at the synchronizing area L1 of the lower horizontal passage 9, the grip mechanism 54 is disengaged from the support member 52, and the vehicle is self-propelled toward the lower inlet/outlet opening 56A. Then, the vehicle 53 is moved into the bottom station 8 through the lower inlet/outlet opening 56A, and moves along the travel passage 9, and stops at the vacant platform 10 to allow the passengers to get off the vehicle. When passengers are to be transported from the bottom station 8 to the top station 7, the vehicle 53 carrying the passengers is guided into the lower horizontal passage 49 through the lower inlet/outlet opening 56B, and the grip mechanism 4 of the vehicle 53 grips the support member at the synchronizing area L2. Then, the vehicle 53 is transferred to the upper horizontal passage 48 through the hoisting or lifting elevator passage 47, and then is moved into the top station 7 through the upper inlet/outlet opening 55B.

The vehicles 53 are successively operated in the above manner, and many vehicles are continuously moved vertically within the elevator passages 46 and 47, thus shortening the waiting time.

In this embodiment, although the vehicle 53 is designed to be suspended directly from the support member 52 connected to the chains 51, elevator frames may be connected to the chains 51 such that the vehicles are loaded into and unload from the respective elevator frames at the synchronizing areas L1 and L2.

Figure 20:
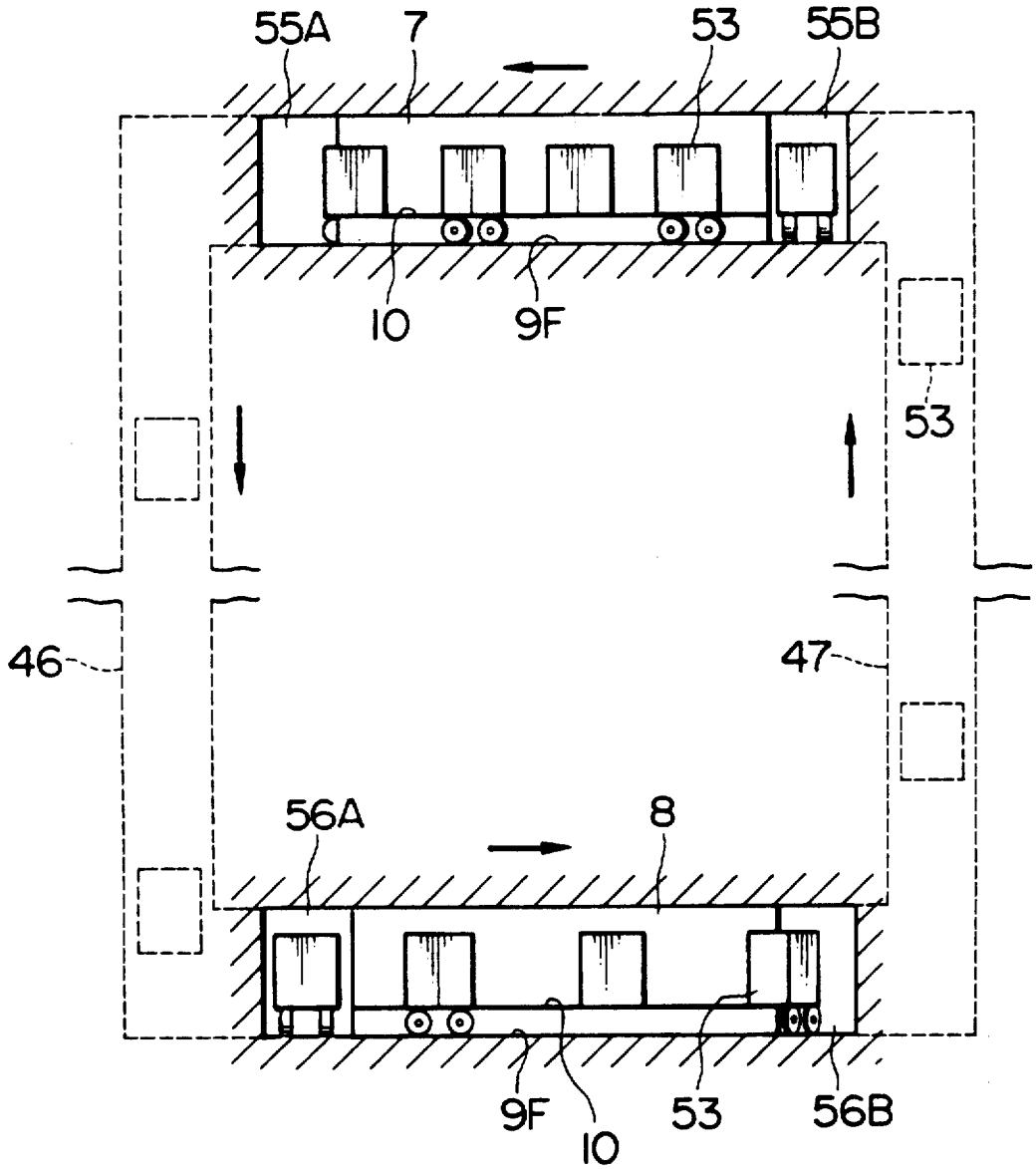
FIG. 20 is a vertical cross-sectional view, showing modified upper and lower horizontal passages used in the installation of FIG. 16.

In the embodiment of FIGS. 16–19, the vehicles are driven for movement along the travel passages by either the drive device mounted on the vehicle or the drive device mounted on the floor. Alternatively, travel passages 9F at the top station 7 and the lower station 8 disposed parallel to the upper and lower horizontal passages extending between the two elevator passages 46 and 47 may have a gradient, as shown in FIG. 20. More specifically, the travel passage 9F of the top station 7 has a falling gradient from the upper inlet/outlet opening 55B toward the upper inlet/outlet opening 55A, and the travel passage 9F of the bottom station 8 has a rising gradient from the lower inlet/outlet opening 56A toward the lower inlet/outlet opening 56B. With this arrangement, the vehicle 53 can be moved by itself. In this case, the speed of the vehicle need be regulated by either an external brake device or a brake device mounted on the vehicle. This arrangement obviates the need for the drive device for driving the vehicle 53.

Figure 16:
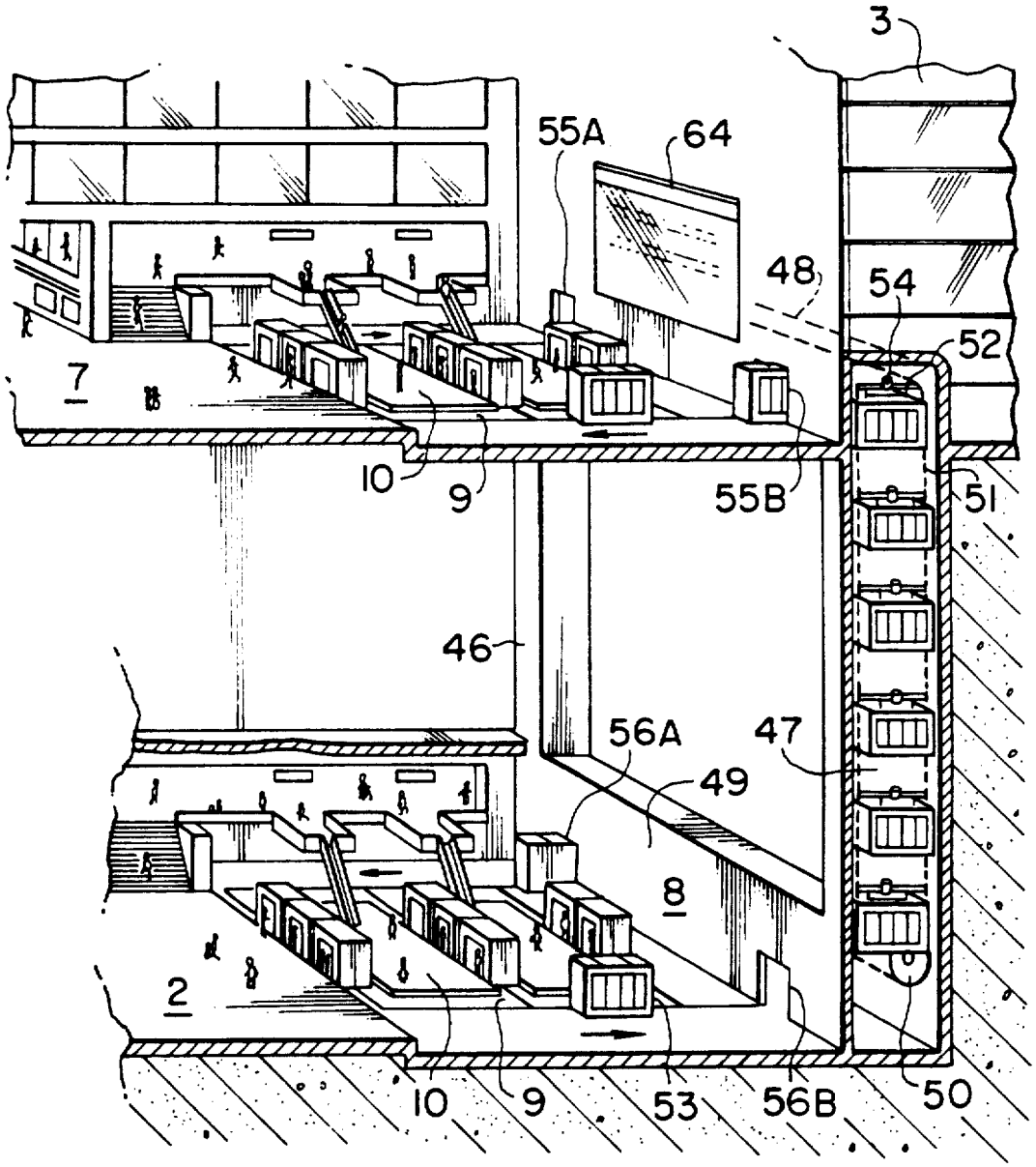
FIG. 16 is a partly-broken, perspective view of a further modified passenger transport installation of the present invention.
Figure 17:
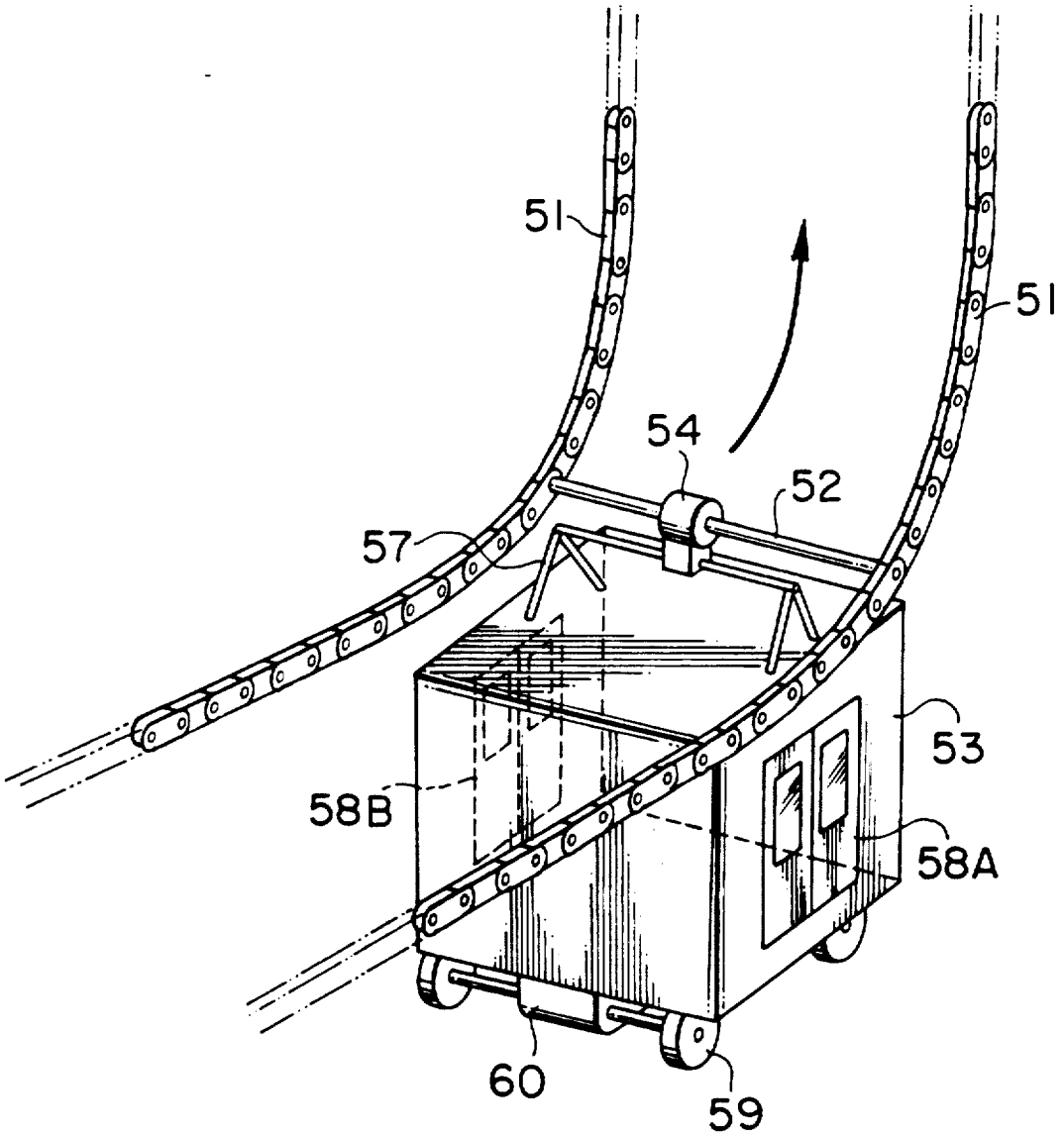
FIG. 17 is an enlarged perspective view of a vehicle used in the installation of FIG. 16.
Figure 18:
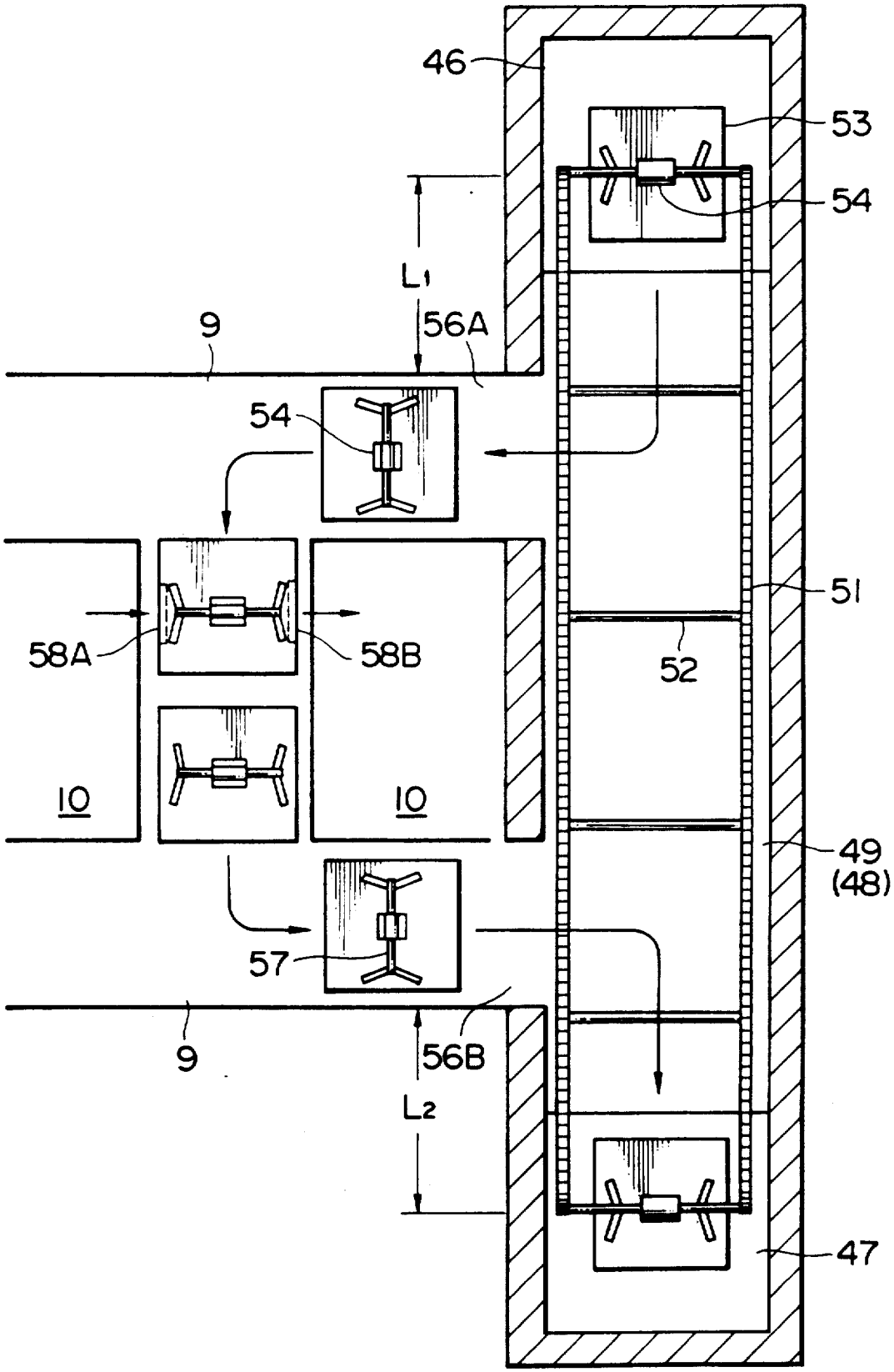
FIG. 18 is an enlarged horizontal cross-sectional view, showing a bottom station of the installation of FIG. 16.
Figure 19:
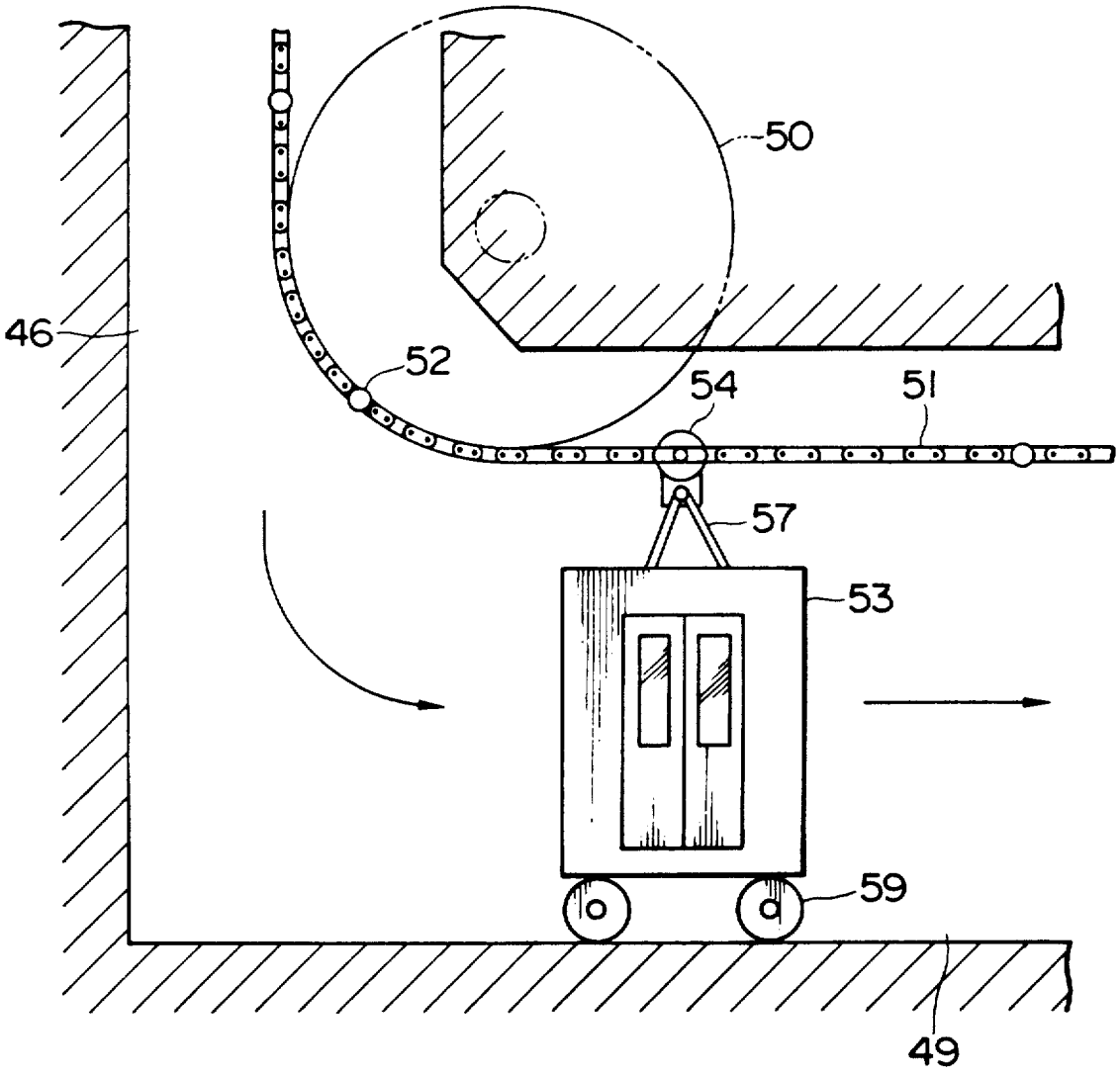
FIG. 19 is an enlarged side-elevational view, showing a vehicle in a lower horizontal passage of the installation of FIG. 16.
Figure 21:
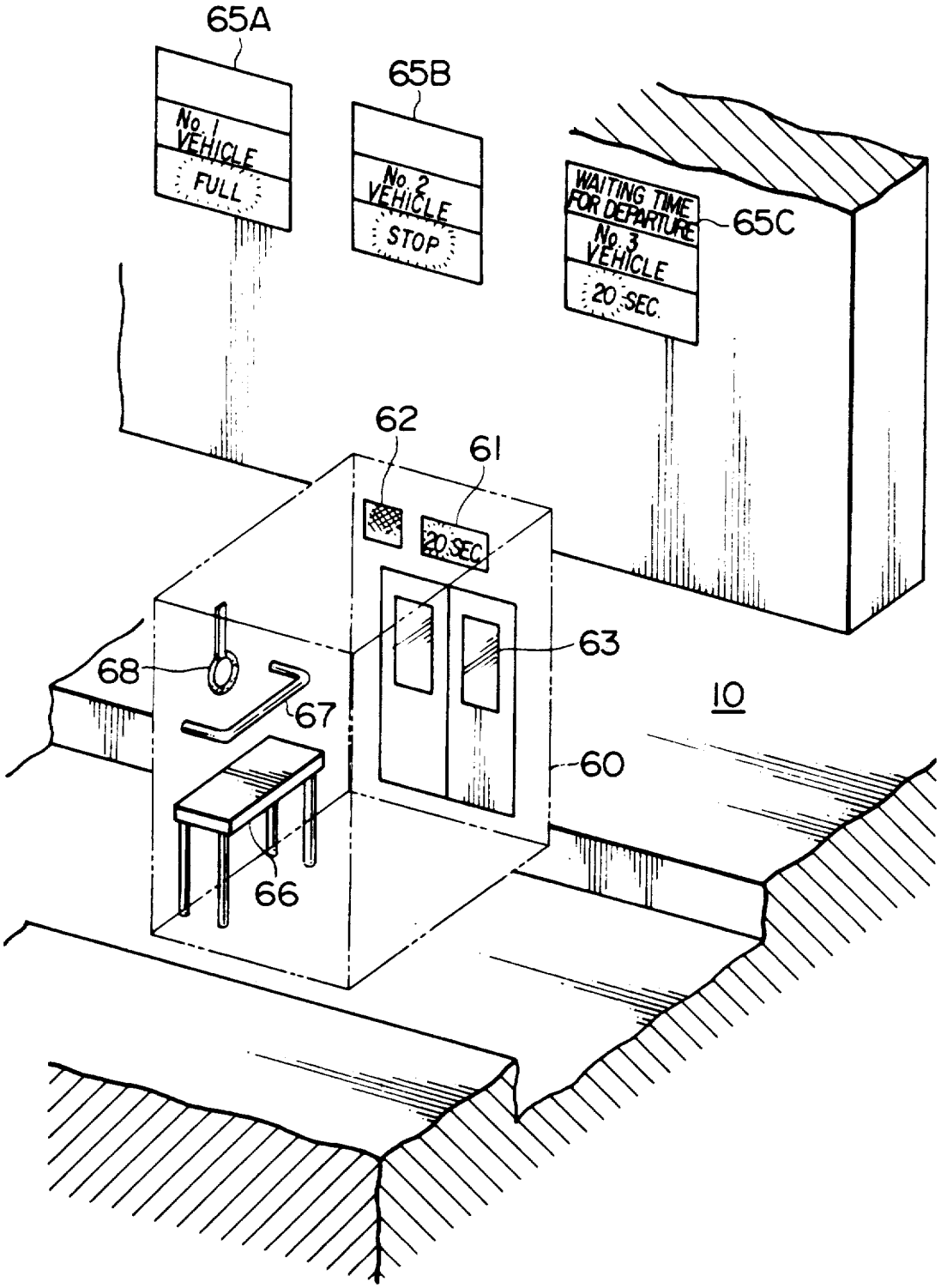
FIG. 21 is a schematic perspective view, showing the relation between a vehicle and a station according to the invention.

FIG. 21 shows one example of an indication device provided at the vehicle and the stations. While passengers getting on a vehicle 60 wait for departure, they often feel somewhat irritated before the vehicle starts moving toward the elevator passage. It is 1 necessary to relieve such irritation, and one means for achieving this is anyway to move the vehicle 60 toward the elevator passage at a low speed. In addition, a departure time indication device 61 (which, for example, indicates the departure time in a count-down manner) and a voice indicator 62 may be provided within the vehicle 60, and, the vehicle may be provided with windows through which the passengers within the vehicle can view a multi-vision device 64 (FIG. 16). These serve to relieve the irritation of the passengers. These are services to the passengers within the vehicle 60. For passengers on the platform 10, information panels 65A to 65C, respectively representing the departure waiting times and other conditions of the respective vehicles, are mounted on the nearby wall. With this arrangement, the passengers can select suitable vehicle.

Further, hand straps, chairs, handrails, etc., may be provided within the vehicle 60 so as to improve the safety of the passengers.

What is claimed is:

1. A building structure comprising: at least two elevator passages along which vehicles move upwardly and downwardly; an upper communication passage communicating with upper ends of said at least two elevator passages; a lower communication passage communicating with lower ends of said at least two elevator passages; and stations provided in said at least two communication passages, respectively, to allow the vehicles to stop at said station so that passengers can get on and off of the vehicle at said stations.

2. A building structure comprising: at least two elevator passages along which vehicles move upwardly and downwardly; an upper communication passage communicating with upper ends of said at least two elevator passages; a lower communication passage communicating with lower ends of said elevator passages; and stations respectively communicating with said communication passages for allowing vehicles to stop at said stations so that passengers can get on and off of the vehicle at said stations.

3. A passenger transport installation comprising passenger carrying vehicles, elevator drive means for moving the passenger carrying vehicles upwardly and downwardly along an elevator passage, and means extending across said vehicle and said elevator drive means for releasably fixing said vehicles to said elevator drive means, wherein said elevator drive means comprises a motor, rope wheels driven by said motor, a length of rope wound around said rope wheels, and elevator frame means suspended by said length of rope, and wherein said means for releasable fixing is provided across said passenger carrying vehicles and said elevator frame means.

4. A method of controlling an operation of a passenger transportation installation including elevator passages, stations disposed outside of said elevator passages, elevator frames adapted to be moved along the elevator passages and passenger carrying vehicles adapted to be moved upwardly and downwardly along the elevator passages and to be disengaged from said elevator frames to be moved toward said stations, the method comprising the steps of providing stopper means disposed between said elevator passages and said stations for preventing said vehicles from moving into said elevator passages, when passengers are to be transported, and controlling said stopper means such that a vehicle on standby at said station can be moved toward said elevator frames after said elevator frames reach a floor associated with said station.

5. A method of controlling the operation of a passenger transport installation including an elevator passage or passages, stations communicating with the elevator passage or passages, and vehicles for carrying passengers and movable at the elevator passage or passages and the stations, said method comprising the step of sequentially moving the vehicles, which are on stand-by at said station, toward the elevator passage or passages when the waiting time for each of said stand-by vehicles exceeds a predetermined period of time.

6. A method of controlling the operation of a passenger transport installation including an elevator passage or passages, stations communicating with the elevator passage or passages, and vehicles for carrying passengers and movable at the elevator passage or passages and the stations, said method comprising the step of sequentially moving the vehicles, which are on stand-by at said station, toward the elevator passage or passages when each of said stand-by vehicles is fully loaded with passengers.

7. A method of controlling the operation of a passenger transport installation including an elevator passage or passages, stations communicating with the elevator passage or passages, elevator frames movable along the elevator passage or passages, and vehicles for carrying passengers and releaseably engageable with the elevator frame for movement therewith along the elevator passage or passages, said vehicles being disengaged from said elevator frame so as to move to said stations, said method comprising the step of unloading the vehicles from said elevator frame to said station simultaneously when another vehicle is loaded from said station to a different portion of said elevator frame from the portion of said elevator frame where said unloaded vehicle has been placed.

8. A method of controlling the operation of a passenger transport installation including stations where vehicles moving along an elevator passage or passages stop so as to allow passengers to get on and off the vehicles, said stations being connected to stations of another transportation means, said method comprising the step of determining the number of vehicles to be operated, in accordance with a schedule of operation of said another transportation means.

* * * * *